US005186353A

United States Patent [19]

Ramsey

[11] Patent Number: 5,186,353

[45] Date of Patent: * Feb. 16, 1993

[54] SELF-SEALING CLOSURE

[76] Inventor: Douglas P. Ramsey, 20 Ellington Cir., Rochester, N.Y. 14612

[ * ] Notice: The portion of the term of this patent subsequent to Jan. 21, 2009 has been disclaimed.

[21] Appl. No.: 788,551

[22] Filed: Nov. 6, 1991

Related U.S. Application Data

[63] Continuation-in-part of Ser. No. 657,654, Feb. 19, 1991, which is a continuation-in-part of Ser. No. 619,056, Nov. 28, 1990, Pat. No. 5,036,993.

[51] Int. Cl.[5] ..... B65D 51/18; A47G 19/22

[52] U.S. Cl. ..... 220/711; 220/713; 220/714; 220/715; 220/254; 220/282

[58] Field of Search ..... 220/711, 713, 714, 715, 220/719, 253, 254, 281, 282

[56] References Cited

U.S. PATENT DOCUMENTS

| | | | |
|---|---|---|---|
| D. 259,403 | 6/1981 | Frazier, Jr. . | |
| 923,895 | 6/1909 | Ryburg et al. . | |
| 1,020,487 | 3/1912 | Febert . | |
| 1,448,589 | 3/1923 | Ferguson . | |
| 1,803,825 | 5/1931 | Abernathy . | |
| 2,033,042 | 3/1936 | Mazella . | |
| 2,123,795 | 7/1938 | Partin . | |
| 2,447,870 | 8/1948 | Polcyn . | |
| 2,571,843 | 10/1951 | Dale | 220/713 X |
| 3,048,317 | 8/1962 | Cochrane et al. . | |
| 3,169,679 | 2/1965 | Hunter . | |
| 3,231,155 | 1/1966 | McConnell . | |
| 3,486,665 | 12/1969 | Croce . | |
| 3,739,938 | 6/1973 | Paz | 220/715 |
| 3,800,999 | 4/1974 | Serritella . | |
| 3,938,690 | 2/1976 | Butler | 220/714 |
| 3,977,559 | 8/1976 | Lombardi . | |
| 4,057,167 | 11/1977 | Lee . | |
| 4,106,665 | 8/1978 | Cannon . | |
| 4,121,731 | 10/1978 | Okerstrum | 220/715 |
| 4,138,033 | 2/1979 | Payne et al. . | |
| 4,165,013 | 8/1979 | Lutz . | |
| 4,183,443 | 1/1980 | De Parales et al. | 220/714 |
| 4,184,604 | 1/1980 | Amberg et al. . | |
| 4,190,173 | 2/1980 | Mason et al. | 220/203 |
| 4,190,174 | 2/1980 | Haimowitz . | |
| 4,276,992 | 7/1981 | Susich | 220/254 |
| 4,303,173 | 12/1981 | Nergard | 220/254 |
| 4,345,695 | 8/1982 | Galloway et al. . | |
| 4,350,260 | 9/1982 | Prueher . | |
| 4,361,249 | 11/1982 | Tuneski et al. | 220/254 |
| 4,611,725 | 9/1986 | Kacalieff . | |
| 4,712,704 | 12/1987 | Ramsey et al. | 220/254 |
| 5,036,993 | 8/1991 | Ramsey | 220/713 X |

*Primary Examiner*—Allan N. Shoap
*Assistant Examiner*—Vanessa Caretto
*Attorney, Agent, or Firm*—Cumpston & Shaw

[57] ABSTRACT

A self-sealing closure for sealing a receptacle is disclosed. The closure contains a lid having a depressed area and at least one orifice within the depressed area, and a shutter matching the orifice which contains a lever.

The shutter is held against the orifice. The shutter contains a device for preventing the pushing of the shutter away from the orifice when force is applied to the lever in a direction substantially orthogonal to the plane of the orifice.

9 Claims, 11 Drawing Sheets

SELF-SEALING CLOSURE

This application is a continuation in part of applicant's copending application Ser. No. 07/657,654 filed Feb. 19, 1991, which is a continuation-in-part of applicant's patent application U.S. Ser. No. 07/619,056, filed on Nov. 28, 1990 now U.S. Pat. No. 5,036,993.

FIELD OF THE INVENTION

The present invention relates to self-sealing closures for drinking vessels.

BACKGROUND OF THE INVENTION

U.S. Pat. No. 4,712,704 describes and claims a self-sealing closure for a drinking vessel with a receptacle. The closure contains a lid having a depressed area and at least one orifice within the depressed area, a shutter matching the orifice, means for resiliently holding the shutter against the orifice, and means rotating, within a plane perpendicular to the central axis of the receptacle and lid, the shutter away from the orifice. In the device of the patent, the shutter is normally in a closed position, thereby preventing the passage of fluid through it. The shutter can be moved to the open position by the application of an external force, which need not exceed about 2.8 ounces, applied along the perimeter of the shutter. When the external force ceases to be applied to the shutter, the shutter spontaneously returns to its closed position.

The shutter mechanism of the closure of U.S. Pat. No. 4,712,704 is secured by a tight press fit to the top area of the receptacle. It is relatively difficult to manufacture the closure with this tight press fit. Furthermore, a user of the self-sealing closure could not readily disassemble the closure in order to clean it.

It is an object of this invention to provide a self-sealing closure which allows a user to readily disassemble the closure in order to clean it.

It is another object of this invention to provide a self-sealing closure which, after it has been disassembled, can readily be reassembled.

It is yet another object of this invention to provide a self-sealing closure with improved sealing properties.

It is yet another object of this invention to provide a self-sealing closure which can be readily and economically manufactured.

It is yet another object of this invention to provide a receptacle which is specially adapted to be attached to said self-sealing closure.

It is yet another object of this invention to provide a sealed receptacle comprised of a self-sealing closure wherein the degree of movement of the closure is limited.

SUMMARY OF THE INVENTION

In accordance with the present invention, there is provided a self-sealing closure for drinking receptacles, including (a) a detachable lid covering the receptacle, the lid having a depressed top area and at least one orifice within the depressed top area, (b) a shutter matching the orifice, (c) means for resiliently holding the shutter against the orifice, (d) means for preventing movement of the shutter in a plane perpendicular to the central axis of the receptacle, and (e) means for moving the shutter in a direction substantially parallel to the central axis of the receptacle.

DESCRIPTION OF THE PREFERRED EMBODIMENTS

Figure 1:
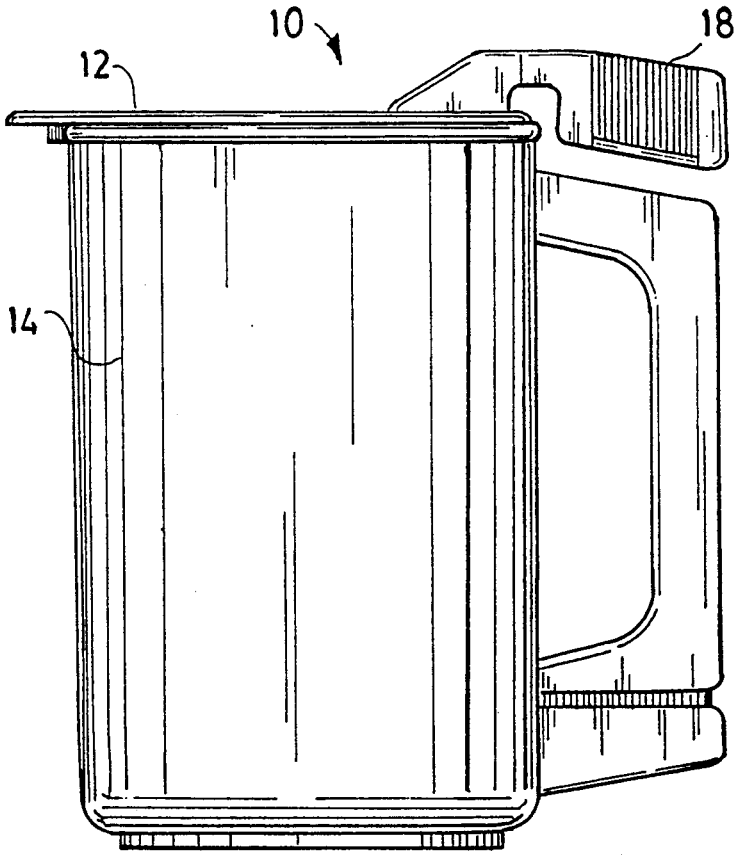
FIG. 1 is a perspective view of one preferred embodiment of the closure of the invention.

FIG. 1 is a perspective view of a preferred embodiment of the self-sealing closure 10 of this invention. Closure 10 is comprised of cover 12 and a lid (not shown). In the embodiment illustrated in FIG. 1, closure 10 is shown as being removably attached to receptacle 14.

In the embodiment illustrated in FIG. 1, closure 10 is shown as having a substantially circular cross section, and it thus is adapted to be removably attached to the substantially cylindrical receptacle 14. It is to be understood that the closure 10 of this invention may be used with any shaped receptacle, and its geometry may be readily adapted to fit said receptacle. Thus, by way of illustration, the closure may have a cross-sectional shape which is square, rectangular, triangular, irregularly shaped, and the like.

In one preferred embodiment, the closure device of this invention is usually used with a vessel for drinking or holding and pouring powdered and/or liquid substances which is generally comprised of a cup-shaped receptacle.

Figure 2:
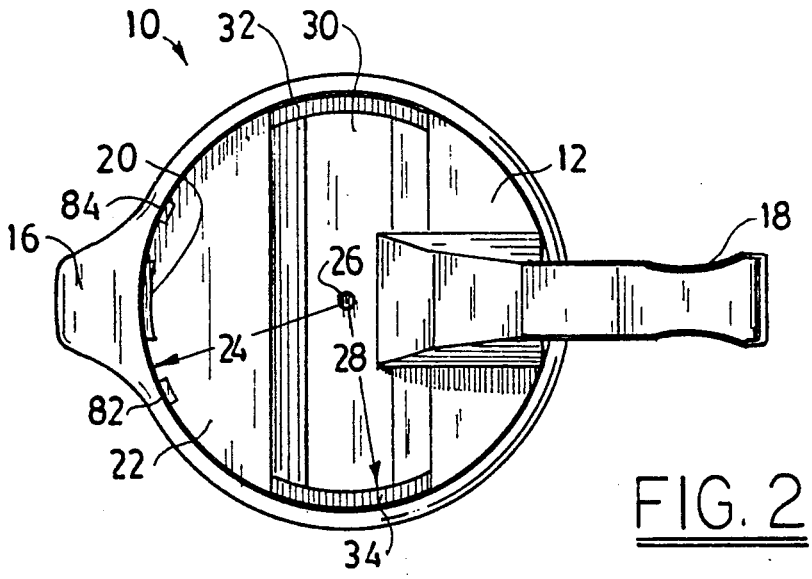
FIG. 2 is a top view of the embodiment of FIG. 1.

FIG. 2 is a top view of the closure device 10 of the invention. Referring to FIG. 2, it will be seen that closure 10 is comprised of cover 12 and lid 16. Cover 12 is integrally formed with and comprises a lever 18.

The closure device 10 of this invention is self-sealing. The term self-sealing, as used in this specification, refers to a closure device which (1) is normally in a closed position, in which it prevents the passage of fluid through it, (2) can be moved to an open position by the application of an external force, and (3) will spontaneously return to the closed position once the external force has been removed. In the embodiment illustrated in FIGS. 1 and 2, the external force may be applied to lever 18.

In the preferred embodiment illustrated in FIG. 2, lid 16 is comprised of a first horizontally-extending guide slot which is integrally formed as a part of lid 16 and which is adapted to guide the movement of cover 12.

Referring again to FIG. 2, it will be seen that cover 12 contains at least two substantially concentric sections with different radii. Section 22 of cover 12 has a radius 24 (as measured from midpoint 26) which is greater than the radius 28 of section 30. It will be apparent to those skilled in the art that the use of at least two sections with different radii on cover 12 creates flow paths 32 and 34 when cover 12 is removably attached to lid 16.

It will be apparent to those skilled in the art that, when the geometry of lid 16 is changed, the corresponding geometry of cover 12 also should change. In any event, in this preferred embodiment, the cover should be configured that, on at least one portion of least two different sides of the cover, the cover, when removably attached to the lid, will not cover the entire portion of the lid, thereby providing flow paths.

Figure 3:
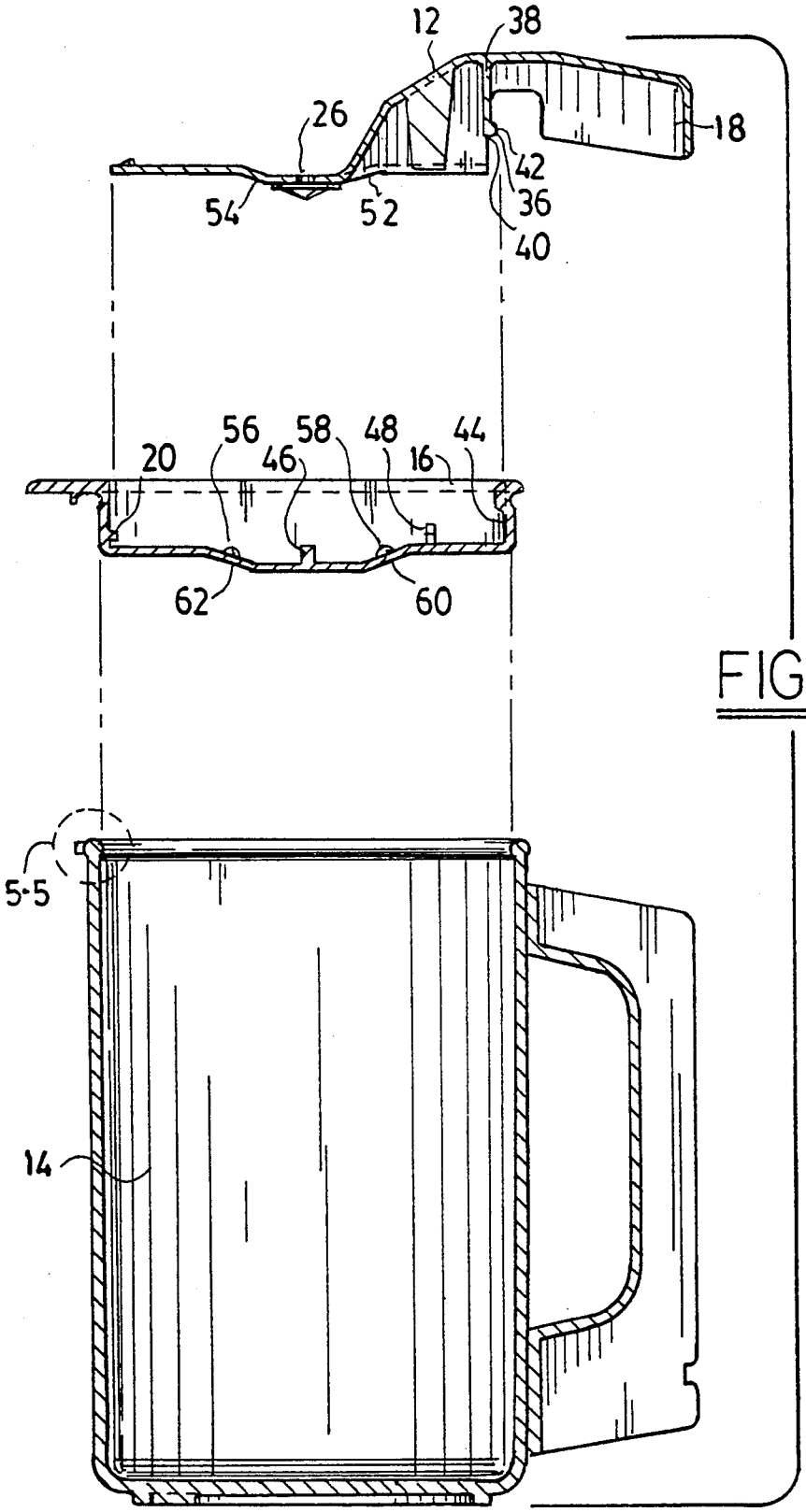
FIG. 3 is an exploded view of the embodiment of FIG. 1.

FIG. 3 is an exploded perspective view of the self-sealing closure of FIG. 1.

Referring to FIG. 3, it will be seen that cover 12 comprises a projection 36 adapted to removably attach cover 12 to lid 16. This "finger snap" projection 36 is preferably integrally formed as part of cover 12 and preferably extends downwardly from point 38 to point 40. terminating in hook 42. Hook 42 is adapted to be received within undercut area 44 of lid 16, thereby removably attaching the cover 12 to the lid 16 when they are forced together.

Referring again to FIG. 3, lid 16 is comprised of an upwardly-extending finger 46 which is adapted to fit within orifice/midpoint 26 of cover 12. The combination of finger 46 and midpoint/orifice 26 helps center cover 12 when it is pushed down onto lid 16, and the force fit of finger 46 in orifice 26 provides one means of removably attaching cover 12 to lid 16.

In the closure device 10 of this embodiment of the invention, it is preferred that there be at least two means of removably attaching cover 12 to lid 16. One such means is the self-centering combination of finger 46 and midpoint/orifice 26. Another such means is guide slot 20. Yet a third such means is the combination of projection 36 and undercut 44. Yet a fourth such means is the combination of the notch and receptacle illustrated in FIGS. 4, 5 and 5A.

Without wishing to be bound to any particular theory, applicant believes that, because the closure of this embodiment of the invention comprises at least two separate means for removably attaching the cover 12 to the lid 16, such attachment is more secure than it would be were only one such attachment means to be used.

Referring again to FIG. 3, cover 12 is comprised of a downwardly extending spring 50 which is designed to fit between two upwardly extending slots, only one of which (slot 48) is shown in FIG. 3. The spring 50, which is an elastic body which preferably is about 0.06 inches thick, limits the extent to which the cover 12 may be rotated in a direction substantially orthogonal to the plane of orifice 26. When cover 12 has been rotated in a direction substantially orthogonal to the plane of orifice 26, the combination of spring 50 and said upwardly extending slots provide a first means tending to return the shutter to its normally closed position. In addition, the provision of ramp surfaces on the cover 12 provide a second means for returning the shutter to its normally closed position.

Referring again to FIG. 3, it will be seen that, it the preferred embodiment of this Figure, cover 12 is comprised of ramps 52 and 54, which are adapted to mate with dimples 56 and 58 of lid 16.

There are at least two dimples 56 and 58 on the interior surface of lid 16. In one preferred embodiment, illustrated in FIG. 12, there are four such dimples (dimples 56, 58, 57, and 59). When cover 12 is removably attached to lid 16, and the closure is in its normally closed position, each of ramp surfaces 52 and 54 is contiguous with at least one of said dimples.

In a preferred embodiment, lid 16 also is comprised of ramps 60 and 62.

Without wishing to be bound to any theory, applicant believes that the provision of at least two separate means for limiting the extent to which the cover 12 may be rotated in a direction substantially orthogonal to the plane of orifice 26 substantially increases the efficiency of this embodiment of applicant's closure.

The first such means is the combination of spring 50 and said upwardly extending slots. The second such means is the combination of the ramp structures contained in cover 12 and the dimples 56 and 58.

Figure 4:
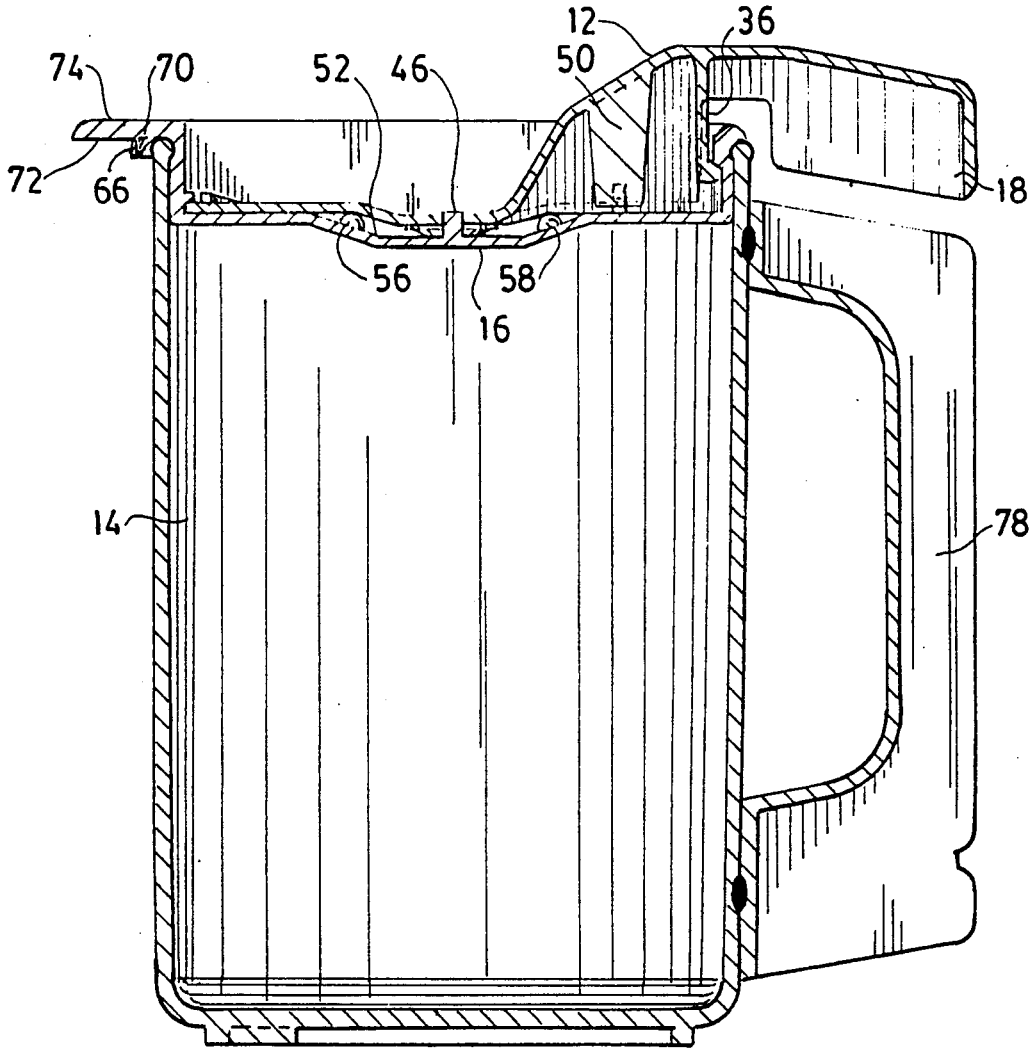
FIG. 4 is a sectional view of the embodiment of FIG. 1.
Figure 5:
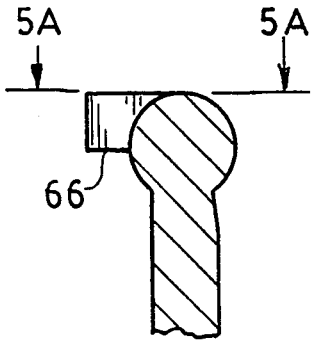
FIG. 5 is a sectional view, taken along lines 5—5 of FIG. 3, illustrating one means of locking the closure onto a receptacle.

FIG. 4 illustrates that, when cover 12 and lid 16 are removably attached to each other, several means are provided which tend to maintain the cover and lid in fixed spatial relationship to each other.

Referring to FIG. 4, the friction fit between upwardly extending finger 46 and orifice/midpoint 26 tends to maintain cover 12 and lid 16 in a fixed spatial relationship.

Referring again to FIG. 4, the positioning of spring 50 between the upwardly extending slots also tend to maintain cover 12 and lid 16 in a fixed spatial relationship.

Referring again to FIG. 4, the friction fit of hook 42 within undercut 44 also tend to maintain cover 12 and lid 16 in a fixed spatial relationship.

In one preferred embodiment, means are provided for removably attaching closure 10 to receptacle 14. One such means is the friction fit between the closure 10 and the receptacle 14. Another such means is the notch and receptacle arrangement illustrated in FIGS. 4, 5 and 5A.

Figure 5A:
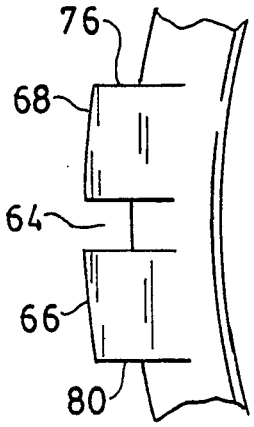
FIG. 5A is a top view of the locking means of FIG. 5.

Referring to FIG. 5A, it will be seen that the receptacle 14 illustrated in said Figure is comprised of a notch 64, which is integrally formed as a part of the perimeter of receptacle 14. As will be seen by referring to FIG. 5A, notch 64 is formed by horizontally-extending fingers 66 and 68.

A key 70 extends downwardly from the lower surface 72 of tab 74. This key 70 may be disposed to fit within notch 64, in which case lid 16 is centered on receptacle 14. Alternatively, key 70 may be disposed to fit on side 76 of finger 68, in which case the lid 16 is offset to the left of the handle 78 of the receptacle 14. Alternatively, key 70 may be disposed to fit on side 80 of finger 66, in which case the lid 16 is offset to the right of the handle 78. With this arrangement, a user may dispose the lever 18 to the left or the right of handle 78 (depending upon whether the user is left-handed or right handed) or, alternatively, center such lever.

Figure 6:
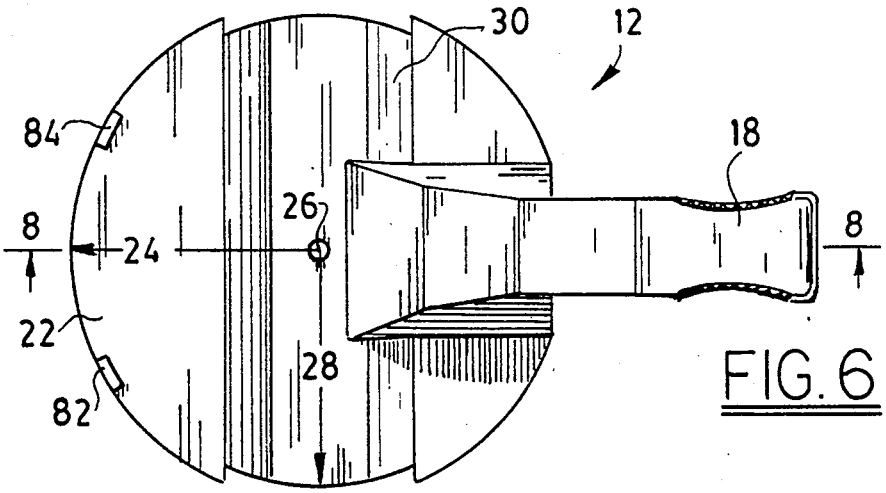
FIG. 6 is a top view of the cover used in the closure of FIG. 1.
Figure 7:
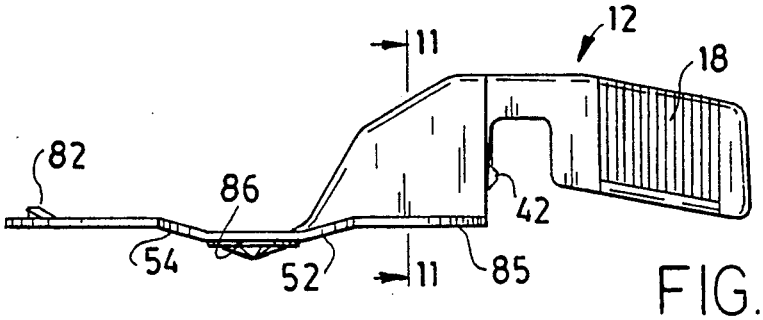
FIG. 7 is a side view of the cover of FIG. 6.
Figure 8:
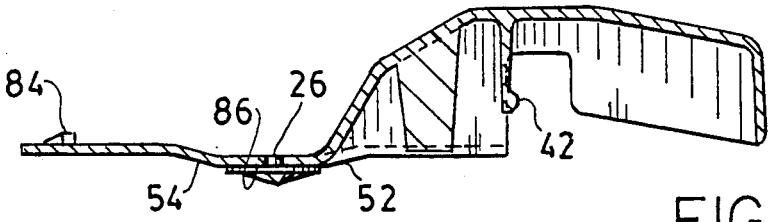
FIG. 8 is a sectional view of the cover of FIG. 6, taken along lines 8—8 of FIG. 6.

FIG. 6 is a top view of the cover 12 of the preferred closure 10 of this invention. Referring to FIG. 6, it will be seen that cover 12 is preferably comprised of at least two upwardly extending projections 82 and 84 which are adapted to contact guide slot 20 when cover 12 has been rotated beyond a certain point; projection 82 is also shown in FIGS. 7 and 8. This means for limiting the rotation of cover 12 may be better seen by reference to FIG. 2.

FIG. 7 is a side view of the cover 12 of FIG. 6. It will be noted that the bottom surface 85 of cover 12 is comprised of ramps 52 and 54. It is also comprised of a relatively level section 86. As will be seen from FIG. 8, level section 86 is near midpoint/orifice 26.

Figure 9:
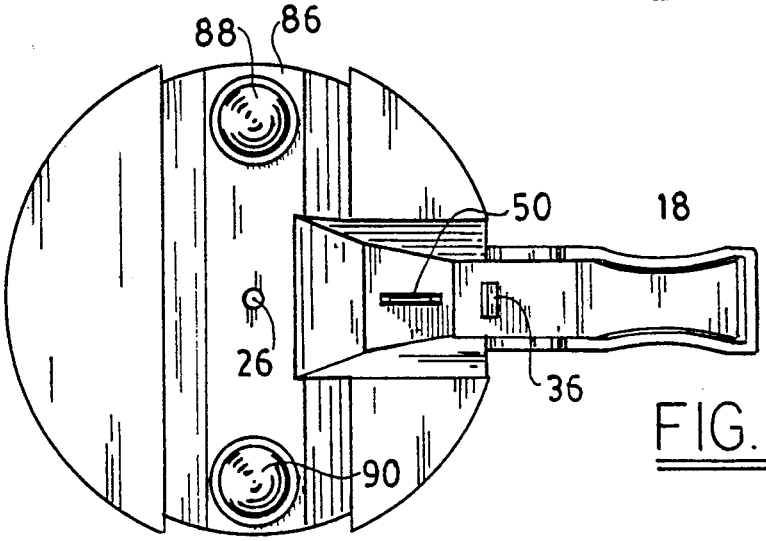
FIG. 9 is a bottom view of the cover of FIG. 6.

On the bottom surface of level section 86 is at least one dimple 88 which is adapted to mate with a corresponding orifice in lid 16. Referring to FIG. 9, which is a bottom view of cover 12, it will be seen that cover 12 is preferably comprised of at least two downwardly extending dimples 88 and 90. These dimples are preferably located on section 30 of cover 12.

Figure 10:
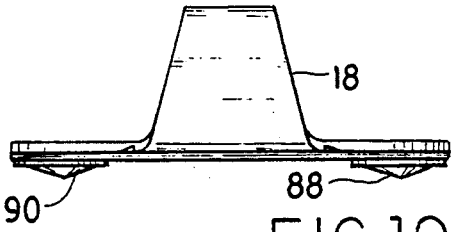
FIG. 10 is an end view of the cover of FIG. 6.

FIG. 10 is a back view of cover 12.

Figure 11:
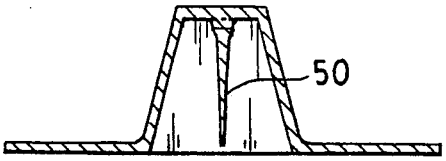
FIG. 11 is a sectional end view of the cover of FIG. 6.

FIG. 11 is a sectional view of cover 12, taken as shown in FIG. 7. The downwardly extending spring 50 is shown. Spring 50 may comprise or consist essentially of elastic material which, after it has been deformed and the deforming force has been removed, will return to its original shape.

Figure 12:
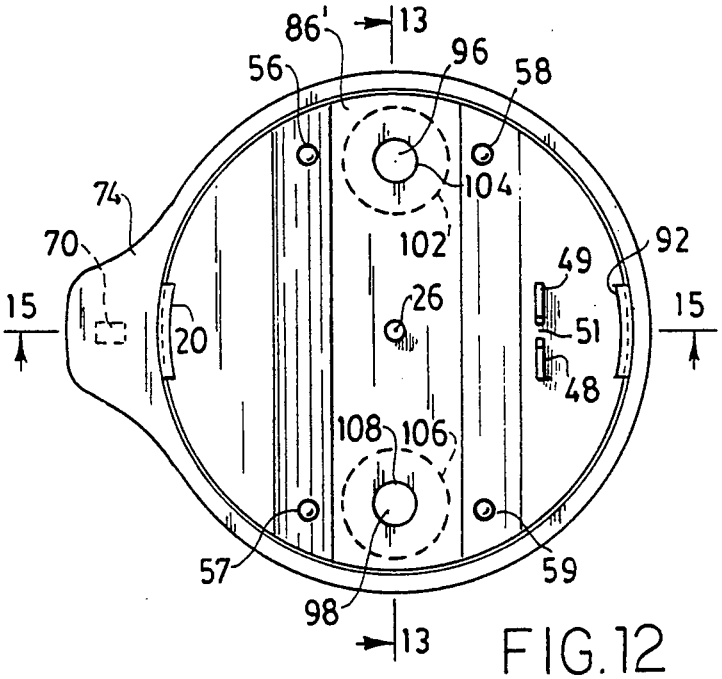
FIG. 12 is a top view of the lid of the closure of FIG. 1.

FIG. 12 is a top view of lid 16. Referring to FIG. 12, it will be seen that the lid 16 is comprised of slot guides 48 and 49 defining a slot 51 between them in which spring 50 may be disposed. Lid 16 is also comprised of means 92 for removably attaching cover 12 to lid 16.

Figure 13:
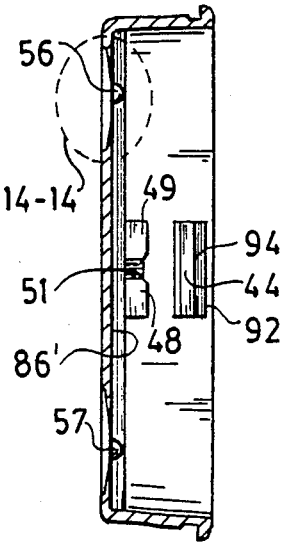
FIG. 13 is a sectional view, taken along lines 13—13 of FIG. 12, of the lid of FIG. 12.

Means 92 is illustrated in FIG. 13. As will be apparent to those skilled in the art, when cover 12 is forced onto lid 16, hook 42 of downwardly extending projection 36 (not shown) will be forced over protrusion 94 into undercut area 44, where it will nest until displaced by the application of a suitable amount of force.

Figure 14:
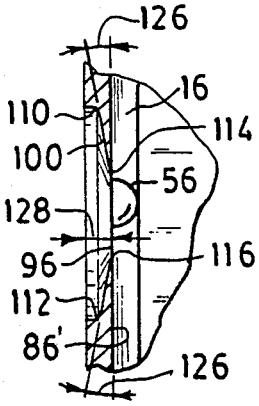
FIG. 14 is a partial exploded view of the thin walled orifice used in the lid of FIG. 12.
Figure 22:
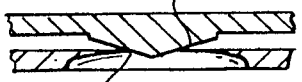

Referring to FIGS. 14 and 22, dimple 88 partially extends through orifice 96 of lid 16. Downwardly extending dimple 90 (not shown) also partially extends through orifice 98 (not shown) of lid 16.

As is illustrated in FIG. 14, each of orifices 96 and 98 preferably comprises a recessed section 100 on the bottom surface of lid 16.

Referring again to FIG. 12, each of orifices 96 and 98 is defined by concentric circles 102, 104 (for orifice 96) and concentric circles 106 and 108 (for orifice 98). The material enclosed between circles 102 and 104, and between circles 106 and 108, preferably has a substantially smaller thickness than the material which exists outside of such concentric circles. This thin-walled feature of the material defining orifices 96 and 98 is an important part of applicant's invention.

Lid 16 includes level section 86' corresponding to level section 86 of cover 12, wherein the level section 86 preferably has a width which is substantially the same as the width of the other sections of lid 16 (excluding the thin walled sections surrounding orifices 96 and 98). In any event, it is preferred that the width of level section 86 be greater than the width of the thin walled sections surrounding orifices 96 and 98.

Referring again to FIG. 14, it will be seen that the thin walled section surrounding orifice 96 and tapers from points of maximum thickness (see points 110 and 112) to points of minimum thickness (see points 114 and 116). At the points of maximum thickness, the thickness of the thin-walled section is still substantially smaller than the thickness of the surrounding material comprising level section 86. In one embodiment, the thickness of the level area 86 is at least about 1.2 times as great as the maximum thickness of the thin walled section.

Without wishing to be bound to any particular theory, applicant believes that the relatively thin walled sections surrounding the orifices more readily conform to the shape of the dimples 88 and 90 and, thus, form a better seal with such dimples. In one embodiment, it is preferred that the average thickness of such thin-walled section be from 0.008 to about 0.030 inches.

Referring again to FIG. 14, it is preferred that dimples 88 and 90 have a substantially conical shape.

Figure 15:
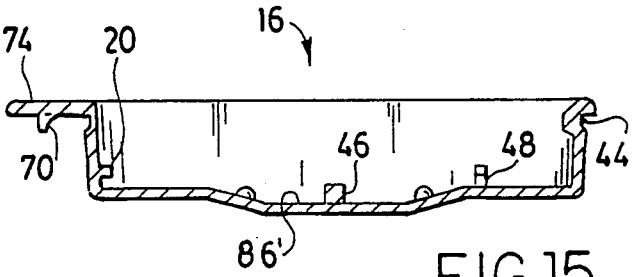
FIG. 15 is a sectional view, taken along lines 15—15 of FIG. 12, of the lid of FIG. 12.

FIG. 15 is a sectional view, taken as shown in FIG. 12, illustrating lid 16.

Figure 18:
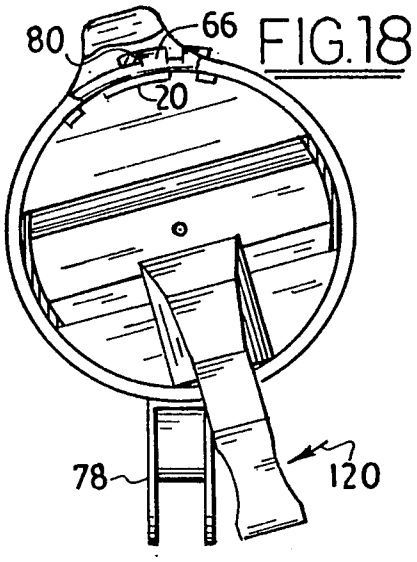
FIGS. 16, 17, 18, 19, and 20 illustrates the operation of the closure of FIG. 1.
Figure 16:
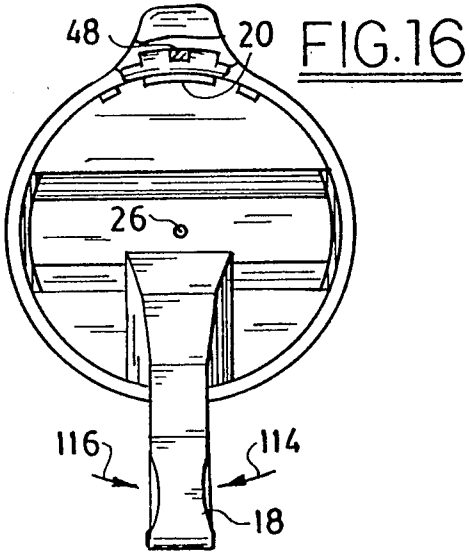
Figure 17:
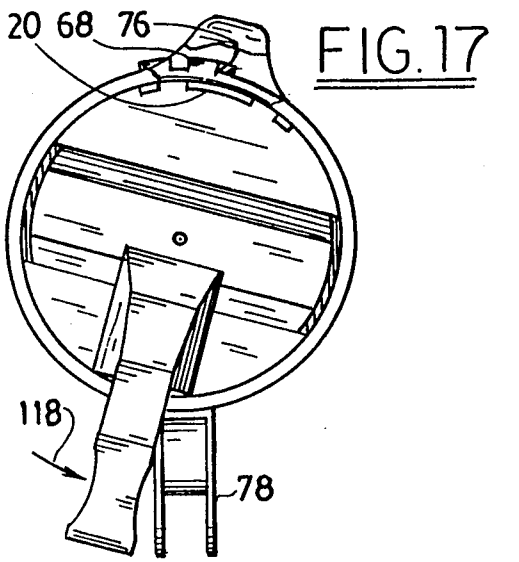

FIGS. 16, 17, and 18 illustrate the versatility of applicant's novel closure device. Referring to FIG. 16, key 70 is disposed within notch 64, and thus cover 12 is so attached to lid 16 that lever 18 is substantially aligned with handle 78 (not shown). From this position, a user may rotate cover 12 in the direction of either arrow 114 or 116 to open the closure in either the left or right direction.

Alternatively, one may lock the closure in the position illustrated in FIG. 17. In this position, key 70 may be disposed to fit on side 76 of finger 68, in which case the lid 16 is offset to the left of the handle 78 of the receptacle 14. From this position, a user may rotate cover 12 in the direction of arrow 118 in order to open the closure.

Alternatively, key 70 may be disposed to fit on side 80 of finger 66, in which case the lid 16 is offset to the right of the handle 78. From this position, a user may rotate cover 12 in the direction shown by arrow 120 to open the closure.

Figure 20:
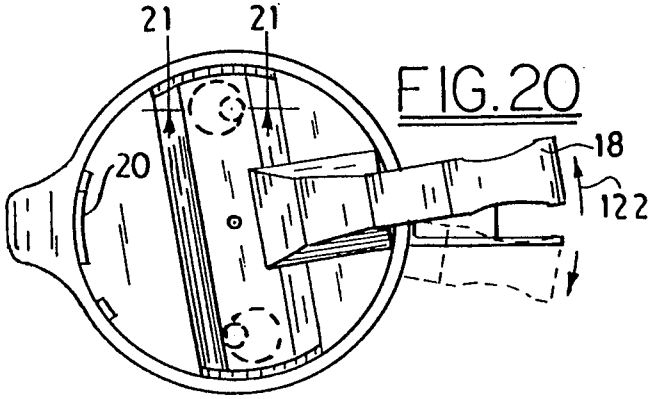
Figure 19:
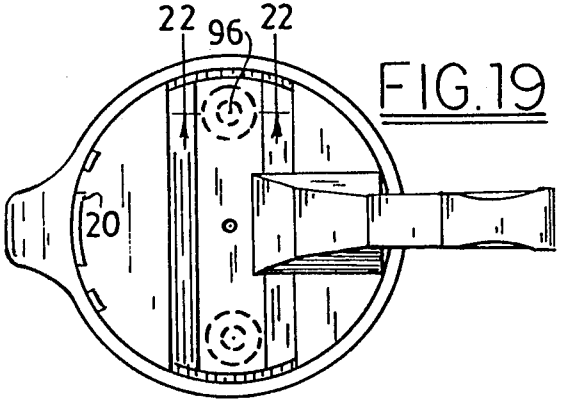

FIG. 19 illustrates closure 10 in its closed position, and FIG. 22 is a cross-sectional view taken through orifice 96 in such position. FIG. 20 illustrates closure 10 in an open position, and FIG. 21 is a cross-sectional view taken through orifice 96 in such position.

Figure 21:
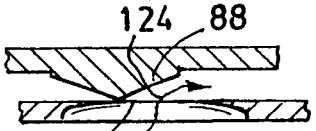
FIGS. 21 and 22 illustrate how the dimples of the cover seal the orifices of the lid of the closure of this invention once they are suitable aligned.

Referring to FIG. 21, it will be seen that the rotation of lever 18 in the direction of arrow causes the cover 12 to ride up the ramp, thereby forcing cover 12 (and its corresponding downwardly extending dimples 88 and 90) up away from lid 16. The reason for this is illustrated in FIG. 12.

Referring to FIGS. 12–14 and 20–22, it will be seen that the relatively level section 86 of cover 12 rests upon 56, 57, 58, and 59 when the closure 10 is in its closed position. When one attempts to open the closure 10 by rotating lever 18 to either side, however, the relatively level section moves towards ramps 60 and 62 of lid 16. As this relatively level section 86 contacts ramps 60 and 62, it is forced by the incline of the ramps up away from the orifices 96 and 98, thereby pulling such downwardly extending dimples 88 and 90 away from the orifices 96 and 98. In such position, fluid may flow through the orifices 96 and 98 and thence through flow paths 32 or 34 to the user. Pressure must be maintained on the lever 18 in order to keep the orifices 96 and 98 open. In the first place, the elastic nature of spring 50 will tend to return the closure 10 to its closed position. In the second place, the elastic nature of cover 12 (which is flexed as it rides up the ramps 60 and 62) will tend to return the closure 10 to its closed position.

Referring again to FIG. 21, which shows the dimple 88 in a position of unstable equilibrium with regard to orifice 96, it will be seen that, because dimple 88 is raised up away from orifice 96, fluid may flow in the direction of arrow 124.

By comparison, and referring to FIG. 22, it will be seen that when the pressure is released on lever 18, the dimple 88 returns downwardly in a nesting position within orifice 96, thereby sealing such orifice.

In one preferred embodiment, the closure is so constructed that lever 18 requires no more than about 2.8 ounces of force applied along the perimeter of the lid within a plane perpendicular to the central axis (midpoint 26) of the lid to move the cover from its normally closed position to its open position. In one embodiment, the force required to move the cover from the closed to the open position does not exceed about 2.0 ounces.

It is preferred that each of the components of the closure device 10 of this invention be comprised of a polymeric material. In a more preferred embodiment, the closure device 10 consists essentially of a polymeric material. By way of illustration and not limitation, some of the polymeric materials which may be used include, e.g., polyesters, linear polyamides, polyurethanes, and the like. Polymeric materials which may be used in the invention are described in, e.g., B. Golding's "Polymers and Resins", (D. Van Nostrand Company, Inc., Princeton, N.J., 1959), the disclosure of which is hereby incorporated by reference into this specification.

One of the preferred classes of materials which can be used in the closure of this invention are the polyolefin resins. These resins are well known to those skilled in the art and are described in, e.g., pages 568–569 of Volume 10 of the "McGraw-Hill Encyclopedia of Science and Technology" (McGraw-Hill Book Company, N.Y., 1977), the disclosure of which is hereby incorporated by reference into this specification.

In one preferred embodiment, the polyolefin resin is selected from the group consisting of high density polyethylene, ultra-high density polyethylene, and mixtures thereof.

In another embodiment, the polyolefin resin is polypropylene.

The polymeric material may be polycarbonate. These polycarbonates are well known to those skilled in the art and are described, e.g. on pages 143–178 of R. Seymour's "Engineering Polymer Sourcebook" (McGraw-Hill Book Company, N.Y. 1990), the disclosure of which is hereby incorporated by reference into this specification.

One class of materials which can be used are the polyacrylonitrile resins. These resins are described in, e.g., pages 534–535 of said "McGraw-Hill Encyclopedia of Science and Technology," supra. The preferred polyacrylonitrile resins are acrylonitrile-butadiene-styrene (ABS) resins.

In one embodiment, the cover 12 consists essentially of polycarbonate, the lid 16 consists essentially of a material selected from the group consisting of polypropylene, polyethylene, and mixtures thereof, and the receptacle 14 preferably consists essentially of polypropylene.

In one preferred embodiment the downwardly extending dimples 88 and 90 each have a substantially conical shape with a taper of from about 0° to about 30° degrees. The dimples 88 and 90 also have a depth of from about 0.020 to about 0.060 inches. In this embodiment, the orifices 96 and 98 which cooperate with dimples 88 and 90 also have a taper. The taper from the perimeter of concentric circle 106 to the perimeter of concentric circle 108 (see FIG. 12), and from the perimeter of concentric circle 102 to the perimeter of concentric circle 104), as measured on the bottom surface of lid 16, will generally be from about 3 to about 9 degrees. The thickness of the wall section as measured at the knife edge of circles 108 and/or 104 will be from about 0.003 to about 0.020 inches thick.

Without wishing to be bound to any particular theory, applicant believes that the use of such tapered components insures a good seal between cover 12 and lid 16 when the closure is in the closed position.

DESCRIPTION OF A SECOND PREFERRED EMBODIMENT

FIGS. 23–37 illustrate another preferred embodiment of the present invention. In this embodiment, the cover, or shutter 12 can be moved from a closed position to an open position by the application of an external force applied within a plane which is substantially parallel to the central axis of the shutter 12 and receptacle 14. In the preferred aspect of this embodiment, means are provided for preventing the movement of the shutter from the closed position to the open position by the application of an external force applied along the perimeter of the shutter within a plane perpendicular to the central axis of the shutter. That is, the second embodiment includes means for preventing rotation of the shutter about the central axis.

Figure 23:
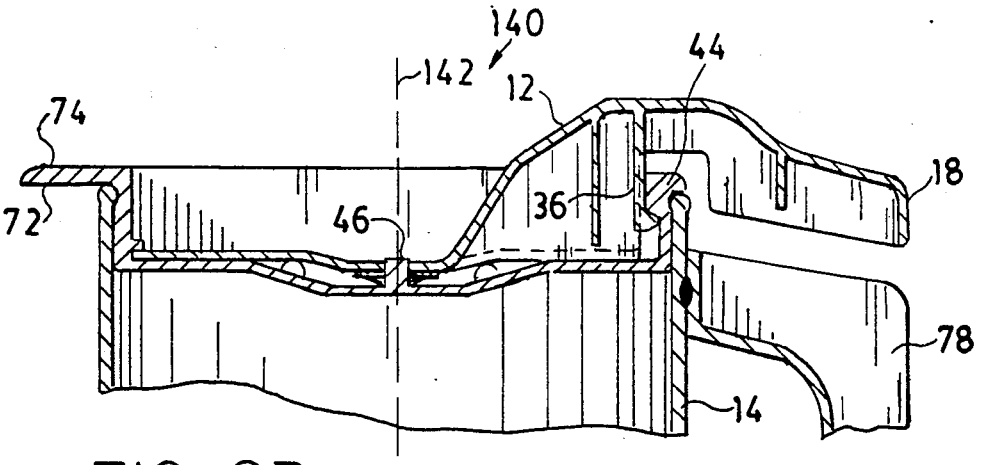
FIG. 23 is a partial sectional view of another preferred embodiment of the invention, showing it in its closed position.

FIG. 23 illustrates a portion of the second preferred embodiment in which a partial sectional view of such self-sealing closure 140 is shown.

Referring to FIG. 23, it will be noted that the embodiment depicted does not contain a spring 50 (see, e.g., FIG. 4). In another embodiment (not shown) the closure 140 does contain a spring 50. However, in many other respects, this embodiment is structurally similar to the embodiment of FIG. 4, and the discussion of the elements of such prior embodiment is substantially applicable to this embodiment.

The closure of FIG. 23 is shown in its closed position. The preferred closure means of the embodiment of FIG. 23 is illustrated in FIG. 24.

Figure 24:
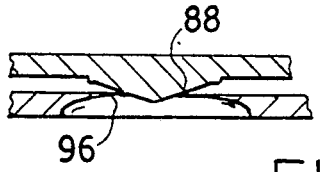
FIG. 24 is a partial sectional view of a flow-blocking means of the embodiment of FIG. 23.

FIG. 24 is a sectional view illustrating downwardly extending dimple 88. Referring to FIG. 24, dimple 88 partially extends through orifice 96 of the lid 16.

The embodiment illustrated in FIGS. 23 and 24 preferably comprises at least one orifice and, more preferably, at least two orifices, each of which is similar to orifice 96. The two orifice arrangement allows a user to drink out of either side of the closure. However, it will be appreciated that embodiments with only one orifice (not shown) or with more than two orifices (not shown) are also desirable.

Another downwardly extending dimple (not shown) also partially extends through another orifice 98 (not shown) of the lid 16.

The orifices 96 and 98 utilized in this embodiment of the invention are similar to the orifices utilized in the prior embodiment of the invention; and the discussion of the orifices of the prior embodiment is equally applicable here.

Referring again to FIG. 24, it will be seen that, when the closure device 140 is in its closed position (as depicted in FIG. 23), no fluid can flow through orifice 96.

Figure 25:
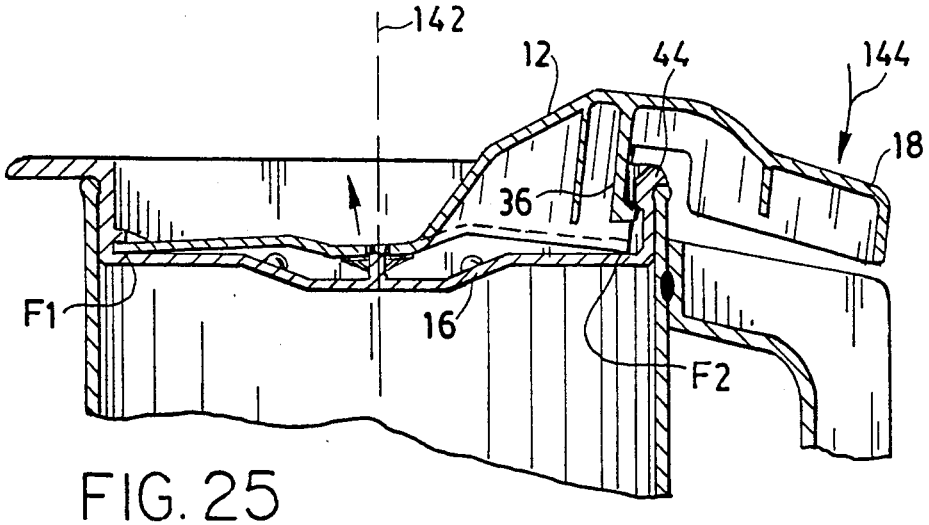
FIG. 25 is a partial sectional view of said other preferred embodiment of the invention, showing it in its open position.
Figure 26:
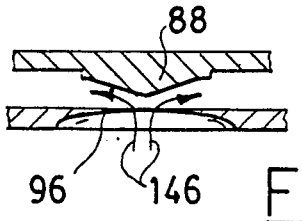
FIG. 26 is a partial sectional view of a flow-allowing means of the embodiment of FIG. 25.

FIGS. 24–26 illustrates how the closure 140 may be moved to its open position by the application of an external force applied within a plane substantially parallel to the central axis of the cover or shutter.

The second embodiment of this invention differs from the first embodiment in several major areas. The closure of the first embodiment could not be opened by the application of an external force applied within a plane parallel to the central axis of the shutter. In contrast, the closure of the second embodiment, permits the passage of fluid through the orifice upon application of a force parallel to the central axis. The second embodiment is provided with means for preventing the movement of the shutter away from its orifice in a direction substantially orthogonal to the plane of the orifice. That is, the second embodiment includes means for preventing rotation of the shutter about the central axis.

Referring to FIGS. 23 and 25, dotted line 142 is substantially coincident with the central axis 142 of the closure 140. In the embodiment illustrated in these Figures, upwardly extending finger 46 is also substantially coincident with the central axis of the closure 140.

The closure 140 may be moved from its closed position (illustrated in FIGS. 23 and 24) to its open position (illustrated in FIGS. 25 and 26) by the application of force on lever 18 in the direction of arrow 144.

It is preferred that the force applied in the direction of arrow 144 to open closure 140 be in a direction substantially parallel to the central axis of the closure 140. As used herein, the term substantially parallel refers to a direction which forms an angle with regard to the central axis which is from about 0° to about 45° degrees and, preferably, from about 0° to about 30° degrees. It will be understood by those skilled in the art that force applied in what is commonly understood to be a substantially up and down direction is "substantially parallel" within the meaning of this specification.

Referring to FIG. 25, it will be seen that the application of force in a direction which is substantially parallel to that of the central axis of the closure 140 raises cover 12 away from lid 16 and allows fluid to flow through the orifice in such lid, such as orifice 96.

Referring to FIG. 26, when force is applied in the direction of arrow 144, dimple 88 is pulled away from orifice 96, and fluid may flow through the orifice in the direction of arrow 146.

Figure 27:
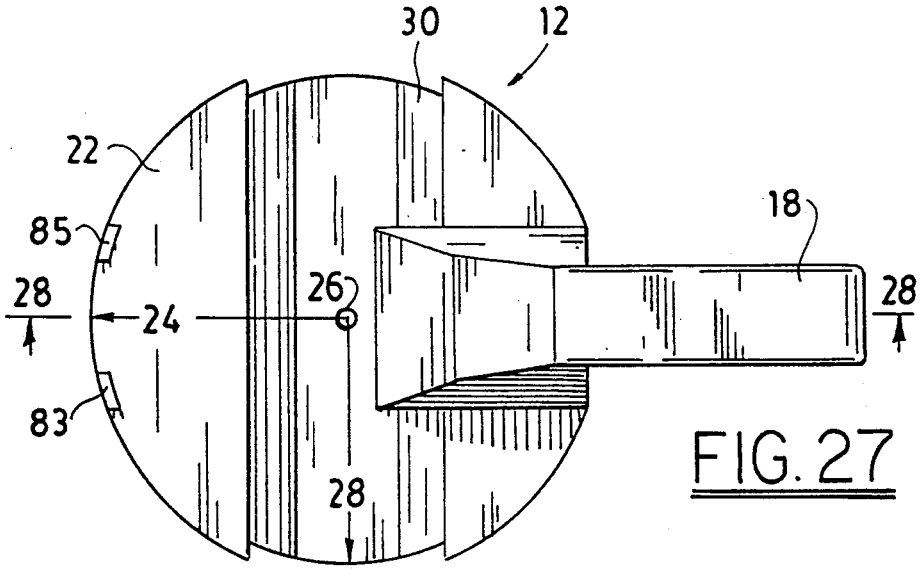
FIG. 27 is a top view of the embodiment of FIGS. 23 and 25.

FIG. 27 is a top view of the cover 12 of the second embodiment of this invention. This cover is very similar in structure to the cover depicted in FIG. 6, and the prior description of the elements they have in common that may be referred to. However, there are certain differences between the two covers.

In the first place, referring to FIGS. 6 and 27, the upwardly extending projections 82 and 84 of the cover of FIG. 6 are spaced more closely together in the cover of FIG. 27, wherein they are identified as upwardly extending projections 83 and 85.

Figure 28:
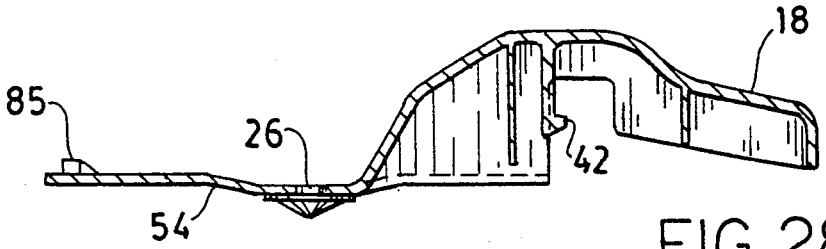
FIG. 28 is a side view of the cover of the embodiment of FIGS. 23 and 25.

FIG. 28 is a side view of the cover of the second embodiment, similar in structure to the top view of the cover of the first embodiment shown in FIG. 7. The covers illustrated in FIGS. 7 and 28 are substantial identical, with the exception that the downwardly-extending spring 50 of the cover of FIG. 7 does not appear in the cover of FIG. 28.

Figure 29:
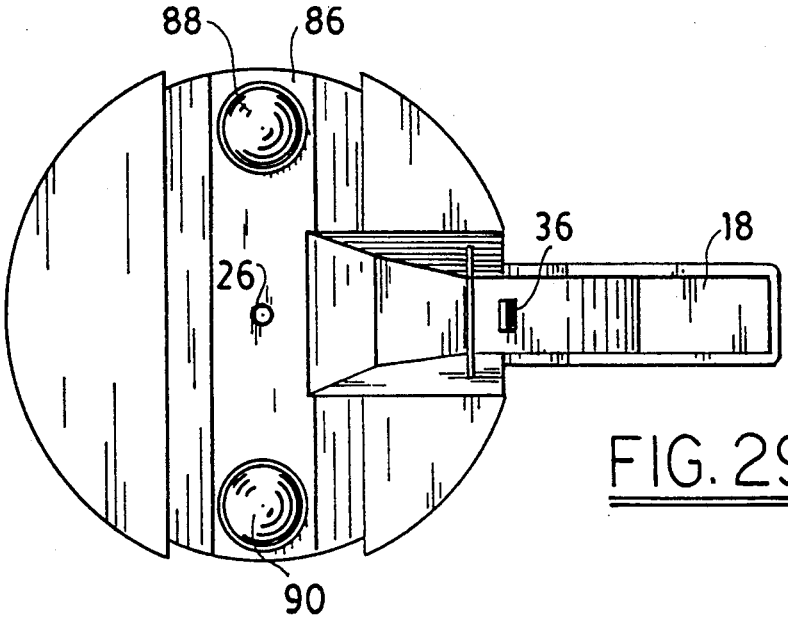
FIG. 29 is a bottom view of the cover of the embodiment of FIGS. 23 and 25.

FIG. 29 is a bottom view of the cover of the second embodiment. Although the embodiments depicted by these Figures are very similar, it should be noted that spring 50 (which appears in FIG. 9) is not shown in the embodiment of FIG. 29.

Figure 30:
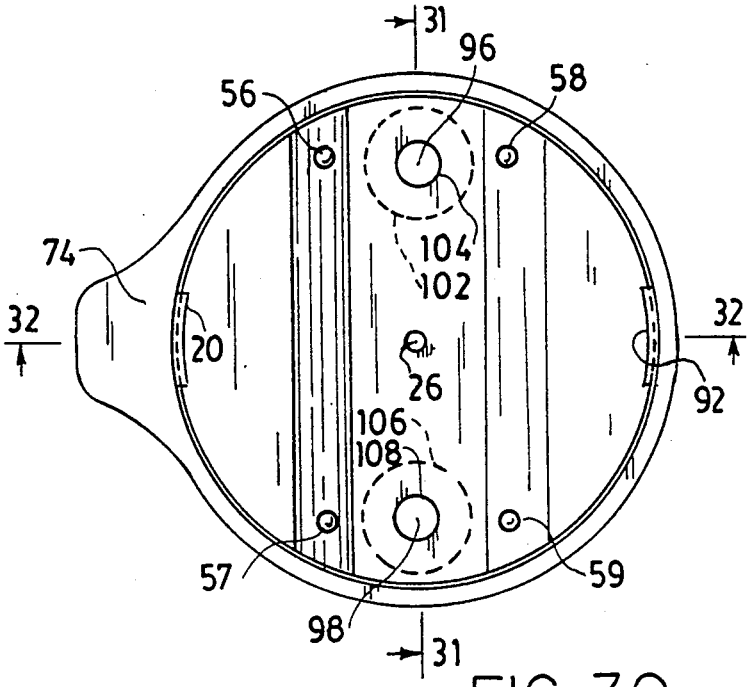
FIG. 30 is a top view of the lid of the embodiment of FIGS. 23 and 25.

FIG. 30 is a top view of the lid of the second embodiment of the closure, similar in structure to the lid depicted in FIG. 12. Although these embodiments are similar in many respects, the following differences exist.

The lid depicted in FIG. 30 does not contain the upwardly extending slots 48 and 49, which appear in the lid of FIG. 12. In addition, the lid depicted in FIG. 30 does not contain the key 70 which appears in the lid of FIG. 12.

Figure 31:
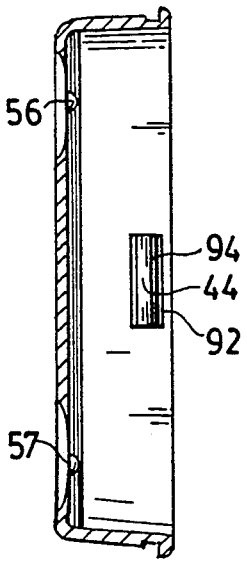
FIGS. 31 and 32 are sectional views of the lid of FIG. 30.

FIG. 31 is a sectional view of the lid of FIG. 30, similar to the sectional view presented in FIG. 13 of the lid of FIG. 12. The most notable differences between these Figures is that the lid depicted in FIG. 31 does not contain the upwardly extending slots 48 and 49 of the lid depicted in FIG. 13.

Figure 32:
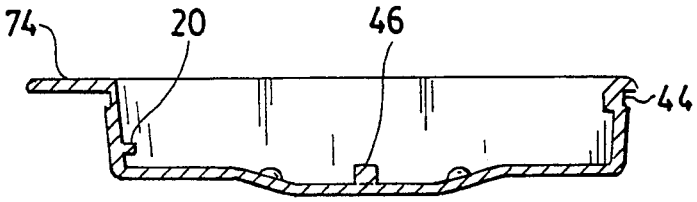

FIG. 32 is a another sectional view of the lid of FIG. 30, similar to the sectional view presented in FIG. 15. The most notable differences between these Figures is that the lid depicted in FIG. 32 does not contain the upwardly extending projections 48 and 49 and the key 70 which are part of the lid depicted in FIG. 15.

Figure 33:
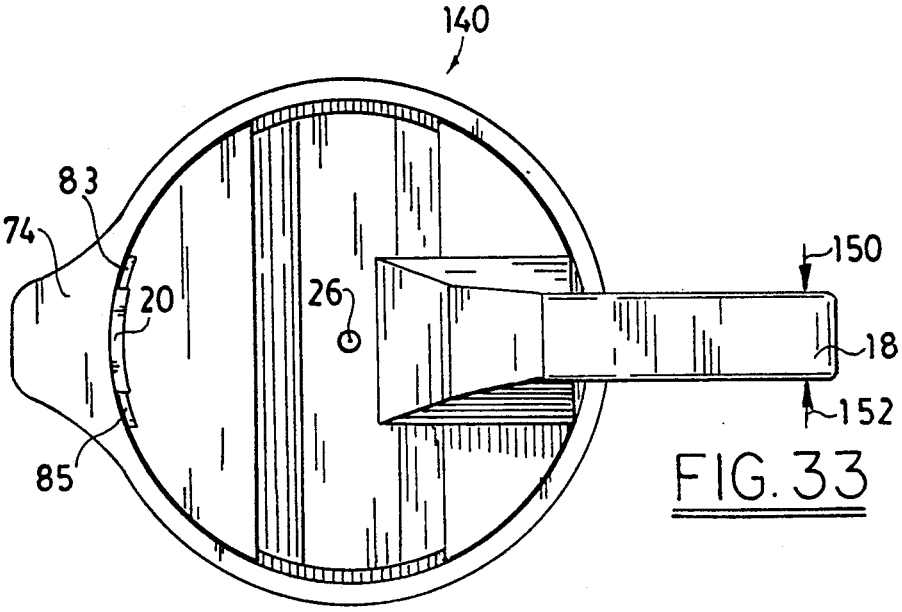
FIGS. 33 is a top view of the lid of the embodiment of FIGS. 23 and 25.

FIG. 33 is a top view of the second embodiment of this invention. It should be noted that horizontally-extending guide slot 20 of the lid 16 is contiguous with each of upwardly-extending projections 83 and 85 of the cover 12. Thus, when the lid and cover are attached to each other (by placing the front portion of the cover under slot 20 and inserting upwardly-extending finger 46 of the lid through orifice 26 of the cover), a force applied in the direction of either arrow 150 or 152 will not move the cover away from the lid; they are locked into place. By comparison, and referring to FIGS. 16, 17, 18 and 20, in the first embodiment of this invention a force applied in the direction of either arrow 114 or arrow 116 will push the cover away from the orifices on the lid in a direction which is substantially orthogonal to the plane of such orifices.

The second embodiment of the present invention employs means for preventing rotation of the shutter about the central axis. A variety of mechanical configurations may be employed to preclude the rotation of the shutter about the central axis.

Figure 36:
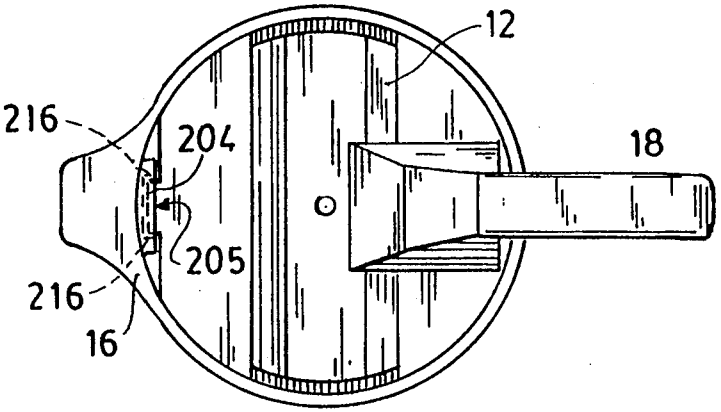
FIG. 36 is a top plan view of an alternative design of the second embodiment.
Figure 37:
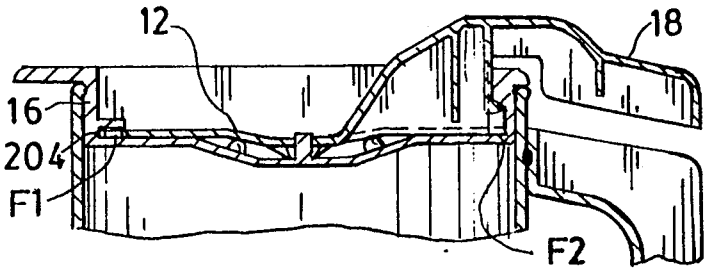
FIG. 37 is a partial cross sectional view showing the closure assembly of FIG. 36.
Figure 34:
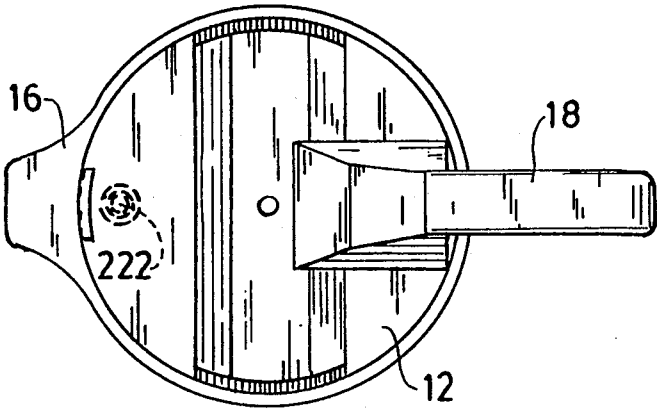
FIG. 34 is a top plan view of an alternative design of the second embodiment.
Figure 35:
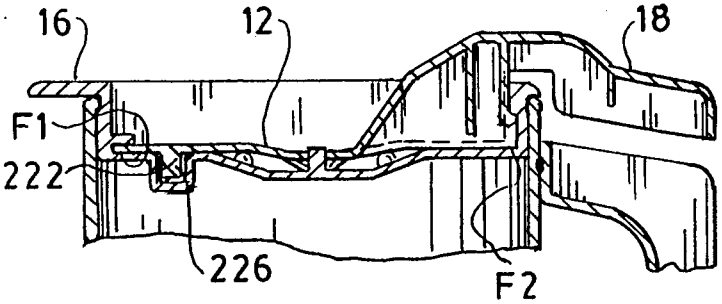
FIG. 35 is a partial cross sectional view showing the closure assembly of FIG. 34.
Figure 38:
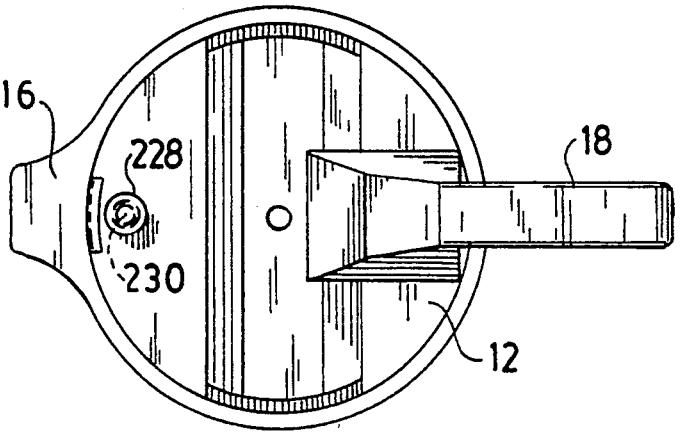
FIG. 38 is a top plan view of an alternative design of the second embodiment and FIG. 39 is a partial cross-sectional view showing the closure assembly of FIG. 38.
Figure 39:
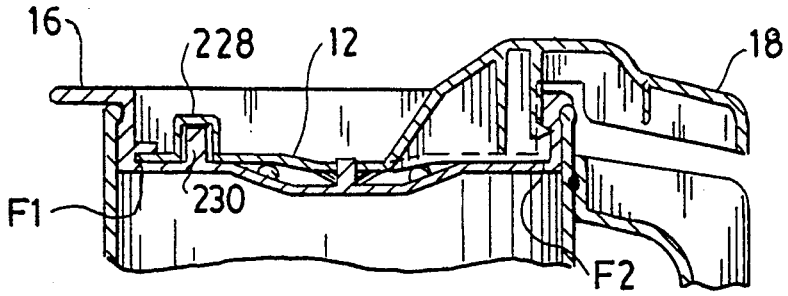

Referring to FIGS. 36 and 37, the shutter includes a peripheral tab 204 projecting outward from the periphery of the shutter. The tab 204 may project from the periphery to be substantially diametrically opposed to the lever 18. The lid 16 includes a corresponding recess 205 into which the tab 204 is releasably received The tab 204 may fit in either by friction fit, or snap connection. Engagement of the tab 204 within the recess 205 prevents rotation of the shutter about the central axis, and provides a fulcrum point for biasing the shutter away from the orifice upon application of a downward force upon the lever 18. The function of the recess 205 may be accomplished by inwardly projecting shoulders 216 on the lid which contact the sides and top of the tab 204. The engagement of the tab 204 and recess 205 or shoulders 216 precludes rotation of the shutter relative to the lid and precludes the neighboring portion of the shutter from being vertically displaced from the lid, thereby allowing a portion of the shutter to be urged away from the orifice. The cooperative engagement of the tab 204 of the shutter and the lid is such that the orifice is intermediate of the tab and the lever.

In another design of the second embodiment the shutter may include a pin 222 projecting downwardly from the surface of the shutter which faces the lid 16. The lid then includes a corresponding recess, or socket 226 into which the pin 222 fits. Preferably, the pin 222 is disposed to be substantially opposed to the lever such that the central axis of the closure or orifice is intermediate of the pin and the lever.

Alternatively, the lid may include an upwardly projecting pin and the shutter may include a correspondingly sized recessed for preventing rotation of the shutter relative to the lid about the central axis. The pin and recess are located such that the orifice is intermediate of the lever and the engagement of the pin and recess.

The pin and recess combination prevent rotation of the shutter about the central axis, and allow for urging the shutter away from the orifice upon application of a downward force, parallel to the central axis, upon the lever.

The releasable engagement of the shutter to the lid is such that a first fulcrum point F1 and a second fulcrum point F2 are formed between the shutter and lid such that the orifice in the lid is intermediate of the first and second fulcrum point, F1,F2 and the second fulcrum point F2 is intermediate of the orifice and the lever 18.

Therefore, upon application of a downward force, substantially parallel to the plane of the central axis, upon the lever, the shutter tends to rotate about the second fulcrum point F2. However, as the first fulcrum point F1 substantially precludes vertical displacement of the shutter relative to the lid, the portion of the shutter between the first and second fulcrum point F1 and F2 flexes upward away from the orifice thereby permitting fluid flow through the orifice. In a preferred design of the second embodiment, the means for preventing rotation of the shutter about the central axis, also forms a first fulcrum point F1, thereby precluding vertical motion of the neighboring portion of the shutter relative to the lid.

In the second preferred embodiment of the present invention, the cooperative engagement of the tab and recess or shoulders, or the cooperative engagement of the pin and corresponding recess of the lid and shutter, form the first fulcrum point F1. The second fulcrum point F2 is formed by a portion of the shutter contacting the lid intermediate of the orifice and the lever.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

What is claimed is:

1. A self sealing closure for sealing a receptacle, the closure having a central axis, comprising:

(a) a substantially annular lid having a top surface and at least one orifice;

(b) a substantially annular shutter matching the orifice, wherein the shutter includes a lever extending beyond the periphery of the shutter;

(c) means for attaching the shutter to the lid; and (d) means for holding the shutter against the orifice such that the shutter is normally in a closed position in which passage of fluid through the orifice is prevented, and the shutter may be moved from its closed position to an open position by the application of an external force applied to the lever in a direction substantially parallel to the central axis of the closure wherein the shutter moves from its closed position to its open position in a direction substantially parallel to the central axis.

2. The self-sealing closure of claim 1, further comprising:

(a) means for preventing rotation of the shutter about the central axis wherein the means for preventing rotation of the shutter comprise a tab projecting from the shutter, and corresponding shoulders on the lid sized to releasably engage the tab.

3. The self-sealing closure of claim 2, wherein the tab is substantially colinear with the lever such that the orifice is intermediate of the lever and the tab.

4. The self-sealing closure of claim 1, wherein the means for preventing rotation of the shutter comprises a pin projecting downward from the shutter and the lid includes a recess sized to releasably engage the pin.

5. The self-sealing closure of claim 4, wherein the orifice is intermediate of the recess and the lever.

6. The self-sealing closure of claim 1, wherein the means for preventing rotation of the shutter includes a pin projecting upwardly from the lid and the shutter includes a corresponding recess sized to releasably engage the pin.

7. The self-sealing closure of claim 6, wherein the orifice is intermediate of the pin and the lever.

8. A self-sealing closure for sealing a receptacle, the closure having a central axis, comprising:

(a) a lid having a top surface and at least one orifice, the lid cooperatively engaging the receptacle;

(b) a shutter having a periphery and matching the orifice, wherein the shutter includes a lever extending beyond the periphery of the shutter;

(c) means for attaching the shutter to the lid to form a first fulcrum point and a second fulcrum point such that the orifice is intermediate of the first fulcrum point and the second fulcrum point, and the second fulcrum point is intermediate of the lever and the orifice; and (d) means for holding the shutter against the orifice such that the orifice is normally in a closed position in which passage of fluid through the orifice is prevented, and the shutter may be moved from its closed position to an open position by application of an external force applied to the lever in a direction substantially parallel to the central axis of the closure, wherein the shutter is urged against the first and the second fulcrum points to move the shutter from its closed position to its open position in a direction substantially parallel to the central axis.

9. The self-sealing closure of claim 8, further comprising:

(a) means for preventing rotation of the shutter about the central axis.

* * * * *